US008281581B2

(12) United States Patent
Oliver et al.

(10) Patent No.: US 8,281,581 B2
(45) Date of Patent: Oct. 9, 2012

(54) CONSTRUCTION FOR AN EXHAUST AFTER TREATMENT DEVICE

(75) Inventors: Matthew R. Oliver, Waterloo, IA (US); David S. Young, Dubuque, IA (US); Cary Wright, Cedar Falls, IA (US); Mike Smith, Waterloo, IA (US)

(73) Assignee: Deere & Company, Moline, IL (US)

( * ) Notice: Subject to any disclaimer, the term of this patent is extended or adjusted under 35 U.S.C. 154(b) by 650 days.

(21) Appl. No.: 12/254,546

(22) Filed: Oct. 20, 2008

(65) Prior Publication Data

US 2010/0095660 A1 Apr. 22, 2010

(51) Int. Cl.
*F01N 1/00* (2006.01)

(52) U.S. Cl. ..... 60/324; 60/322; 60/311; 248/560; 180/309

(58) Field of Classification Search ..... 60/274, 60/285–287, 295–301, 323; 55/385.3; 248/59
See application file for complete search history.

(56) References Cited

U.S. PATENT DOCUMENTS

| | | | | |
|---|---|---|---|---|
| 4,615,500 | A * | 10/1986 | Layson | 248/65 |
| 4,638,965 | A * | 1/1987 | De Bruine et al. | 248/59 |
| 5,082,479 | A | 1/1992 | Miller | |
| 5,570,861 | A * | 11/1996 | Olsen et al. | 248/74.1 |
| 5,649,685 | A * | 7/1997 | Keller | 248/638 |
| 5,873,429 | A * | 2/1999 | Qutub | 180/309 |
| 6,095,460 | A * | 8/2000 | Mercer et al. | 248/59 |
| 6,576,045 | B2 * | 6/2003 | Liu et al. | 95/268 |
| 6,694,727 | B1 * | 2/2004 | Crawley et al. | 60/295 |
| 6,695,295 | B2 * | 2/2004 | Williams | 267/140.13 |
| 6,776,674 | B2 * | 8/2004 | Blanchard | 440/38 |
| 6,851,506 | B2 * | 2/2005 | Bovio | 180/296 |
| 6,935,461 | B2 | 8/2005 | Marocco | |
| 7,025,810 | B2 * | 4/2006 | Crawley et al. | 95/278 |
| 7,249,455 | B2 * | 7/2007 | Tumati et al. | 60/287 |
| 7,278,259 | B2 | 10/2007 | Schmeichel et al. | |
| 7,290,392 | B2 * | 11/2007 | Jones | 60/602 |
| 7,510,043 | B2 * | 3/2009 | Cerri, III | 180/296 |
| 7,678,168 | B2 * | 3/2010 | Connelly et al. | 55/385.3 |
| 7,926,604 | B2 * | 4/2011 | Ammer | 180/89.2 |
| 2005/0279571 | A1 | 12/2005 | Marocco | |
| 2006/0067860 | A1 | 3/2006 | Faircloth, Jr. et al. | |
| 2006/0202480 | A1 * | 9/2006 | Cassel et al. | 285/408 |
| 2007/0062182 | A1 * | 3/2007 | Westerbeke | 60/321 |
| 2008/0205485 | A1 * | 8/2008 | Takahashi | 374/208 |
| 2008/0229821 | A1 * | 9/2008 | Reeder et al. | 73/431 |
| 2009/0232592 | A1 | 9/2009 | Gudorf et al. | |
| 2009/0313979 | A1 * | 12/2009 | Kowada | 60/297 |
| 2011/0023452 | A1 * | 2/2011 | Gisslen et al. | 60/272 |

FOREIGN PATENT DOCUMENTS

| | | |
|---|---|---|
| DE | 102008031136 | 1/2010 |
| WO | 2007117992 | 10/2007 |
| WO | 2008102560 | 8/2008 |

OTHER PUBLICATIONS

European Search Report, 6 Pages, Nov. 15, 2010.

* cited by examiner

*Primary Examiner* — Thomas Denion
*Assistant Examiner* — Jesse Bogue
(74) *Attorney, Agent, or Firm* — Taylor IP, P.C.

(57) ABSTRACT

An exhaust aftertreatment device has a unitary cast inlet that is configurable to have a 90° or 180° entry of combustion gasses relative to flow through tubular elements housing a diesel oxidization catalyst and a diesel particulate filter. The cast component provides the primary structural support for a tubular element connected to the casting element.

15 Claims, 2 Drawing Sheets

CONSTRUCTION FOR AN EXHAUST AFTER TREATMENT DEVICE

FIELD OF THE INVENTION

The present invention mentioned relates to exhaust aftertreatment devices and, more specifically, to the construction of such devices.

BACKGROUND OF THE INVENTION

Ever since the internal combustion engine was commercially developed, it was necessary to treat the exhaust coming from the engine. Such treatment initially included sound suppression, but in the mid 1970's, included exhaust aftertreatment devices in the form of catalytic converters to minimize emissions considered harmful by the Environmental Protection Agency (EPA). With the application of EPA regulations to compression ignition or diesel engines, the process of aftertreatment became more complex since typically the devices included a diesel oxidization catalyst (DOC) and a downstream diesel particulate filter (DPF). The addition of the size and weight of these components has made the mounting of the exhaust aftertreatment device on the frame of a vehicle significantly more difficult. It is of course due to additional weight but, beyond that, the variations in temperature require accommodations for thermal expansion. The process of mounting the exhaust aftertreatment device becomes more difficult because it is necessary not to have any gas leaks.

Typically, exhaust aftertreatment devices carry on the construction of the mufflers and automotive aftertreatment devices in providing stamped steel or fabricated assemblies. This construction emulates the construction of mufflers in having formed end plates and interconnecting elements made of sheet metal and appropriately welded together. The problem with this type of construction is that the increased physical loads and thermal loads coupled with the necessity to properly mount it to a vehicle frame causes increased deflection and with it the increased possibility of leaks and/or structural failure.

Another problem with a fabricated structure is that the orientation of the device is fixed upon completion of the welds. No further flexibility is available to accommodate different spatial positions of the exhaust conduits leading to and away for the device.

Accordingly, what is needed in the art is an exhaust aftertreatment device construction enabling a robust and efficient mounting with flexibility.

SUMMARY OF THE INVENTION

The invention, in one form, is an exhaust aftertreatment device including a structural component receiving internal combustion engine combustion gasses through an inlet integral with the structural component. The structural component has an annular mounting surface formed about a given axis. The structural component has an internal flow passage directing flow of the combustion gasses from the inlet towards a direction substantially parallel with the given axis. A tubular shell is structurally connected to the annular surface and at least one exhaust aftertreatment device is positioned in and carried by the tubular shell so that the exhaust aftertreatment device is substantially supported by the structural component.

In another form, the invention is a vehicle having a frame. An exhaust aftertreatment device includes a structural component receiving internal combustion engine combustion gasses through an inlet integral with the structural component. The structural component has an annular mounting surface formed about a given axis. The structural component has an internal flow passage directing flow of the combustion gasses from the inlet towards a direction substantially parallel with the given axis. A tubular shell is structurally connected to the annular surface and at least one exhaust aftertreatment device is positioned in and carried by the tubular shell. The structural component is adapted to mount to the frame so that the exhaust aftertreatment is substantially supported by the structural component.

DETAILED DESCRIPTION OF THE INVENTION

Figure 1:
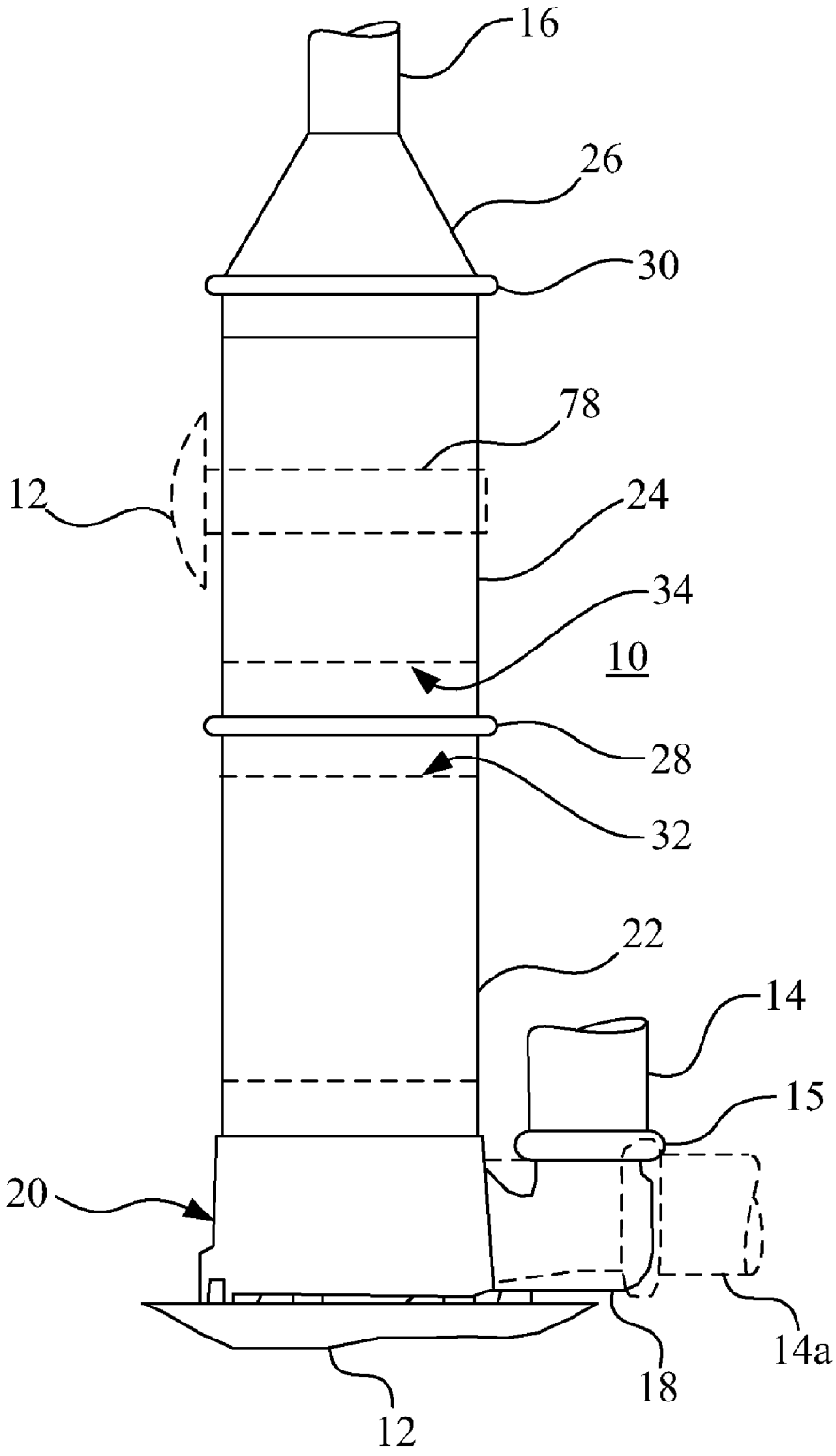
FIG. 1 is a simplified external side view of an exhaust aftertreatment device embodying the present invention, along with selected portions of a vehicle with which it is used.

Referring now to FIG. 1, there is shown an exhaust aftertreatment device 10 for use in treating the exhaust gasses emanating from an internal combustion engine carried by a vehicle 12, only portions of which are shown. Vehicle 12 may be a work machine of the agricultural, industrial, or forestry type, usually powered by a compression ignition, or diesel engine. The diesel engine (not shown) is a highly efficient and durable prime mover. As a result, it is widely utilized in work machines. With recent changes in EPA regulations, however, it is necessary that the exhaust from such engines is treated to bring the level of adverse components within governmental limits. For this purpose, a conduit 14 extends to and receives products of combustion from the engine utilized in vehicle 12. The aftertreatment device 10 may be placed downstream of a turbocharger utilized by the engine or may be placed in between the turbocharger and the engine as appropriate for the particular application. As will be described later, an alternative arrangement for conduit 14*a* may be employed with the exhaust aftertreatment device 10.

The exhaust aftertreatment device 10 includes an inlet section 18, integral structural component 20, and first and second tubular or cylindrical shell components 22 and 24 respectively. As illustrated, downstream tubular component 24 extends to an outlet section 26 having a frustoconical shape to match an outlet conduit 16. As illustrated, the tubular elements 22 and 24 are removably connected by a circumferential Marman clamp 28 and the outlet section 26 removeably connected to tubular element 24 with another circumferential Marman clamp 30. The tubular element 22 provides a housing for, and a support of, a diesel oxidization catalyst (DOC) 32, shown in dashed lines. Diesel oxidization catalyst 32 is a typical element found in an exhaust aftertreatment device. The tubular element 24 is downstream of element 22 and houses a diesel particulate filter (DPF) 34, also shown in dashed lines. Details of these elements are not described to simplify the understanding of the present invention. Diesel particulate filter 34 is carried by and mounted in tubular element 24.

The current way of manufacturing such exhaust aftertreatment device follows the principles found in mufflers and in automotive catalytic converters and current diesel exhaust aftertreatment device. This principle involves making all of the essential components of the aftertreatment device from sheet metal components appropriately formed and welded together to provide the complete structure.

Figure 2:
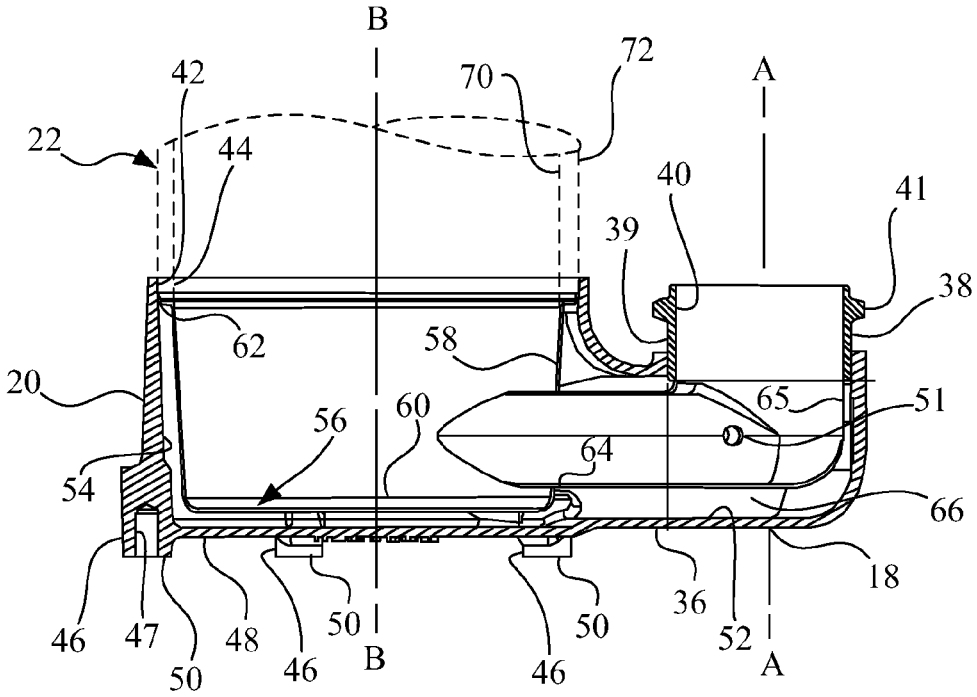
FIG. 2 is an enlarged cross-section view of a component of the exhaust aftertreatment device of FIG. 1.

In accordance with one aspect of the present invention, the exhaust aftertreatment device 10 incorporates the inlet components and structural components 18 and 20 as shown in FIG. 2. Referring specifically to FIG. 2, the inlet element 18 and structural component 20 form a unitary unitary structure. Typically, these elements may be formed as a monolithic casting; however, it is contemplated that the elements may be formed from multiple elements providing a structural unitary component to balance practical casting techniques with the need to provide a completed structure with complex shapes. For example, the inlet element 18 includes a section 36 extending laterally from, and integral with, the structural component 20. A separate annular inlet component 38 extends from, and is received in a through bore 39 in section 36. The inlet component 38 is appropriately secured to section 36. Inlet component 38 has an integral flange 41 surrounding a circular inlet 40 coaxial with an axis A. Flange 41 receives a Marman clamp 15 shown in FIG. 1 to enable releasable connection with the conduit 14.

Inlet section 36 connects with structural component 20 having an annular downstream surface 42 that is formed around an axis B. Circumferential surface 42 is formed on an inner diameter and ends to a shoulder 44. It should be noted that the axis A of the inlet 40 is substantially parallel to the axis B of the circumferential surface 42. Accordingly, the flow passing through the inlet element 18 and 20 makes a turn of 180°. Although a 180° turn is illustrated, it should be apparent to those skilled in the art that the inlet passage axis A may be oriented at a wide range of angle to accommodate different installation requirements for the exhaust aftertreatment device 10.

Structural component 20 has mounting bosses 46 spaced at appropriate locations and integral with the bottom face 48 of structural component 20. Preferably, mounting bosses 46 have appropriate threaded connections 47 to provide removable support to the frame 12 of the vehicle with which the exhaust aftertreatment device 10 is associated (see FIG. 1.). Although the bosses 46 have bottom surfaces 50 that are substantially coplanar, it should be apparent that they may be on different levels as-needed for the particular application. A sensor mounting 51 is provided in the inlet section 36 for a sensor (not shown) that is used in an exhaust aftertreatment control system.

The inlet section 18 has an internal passage 52 leading to a passage 54 which extends to shoulder 44 associated with circumferential mounting surface 42. The net result is that the longitudinal axis of the flow is turned from the left side of the orientation in FIG. 2 to a vertical orientation substantially coaxial with axis B. In order to insulate the structural component 20 and inlet section 18 from the hot exhaust gas flow passing through passages 52 and 54, a sheet metal insert 56 is formed with an annular portion 58, bottom floor 60, and a flange 62 which is supported on shoulder 44. Bottom floor 60 and sidewalls 58 are connected to a sheet metal inlet passage 64. Inlet passage 64 extends to an integral inlet elbow 65 providing an inlet substantially parallel to axis A. The sheet metal flow passage 56 is secured by flange 62 or at its downstream end leaving the upstream end (elbow 65) to float in response to temperature variations in the exhaust gas flow coming into the inlet 18 and the structural component 20. As is apparent from FIG. 2 the sheet metal elements 56 and passage 54 define a gap 66 which provides effective insulation between the gas flow on the interior of sheet metal element 56 and the structural component 20 and inlet section 18. This has the benefit of minimizing thermal stress on the structural component 20 and inlet section 18 and keeping their temperatures within acceptable limits, for example 250 degrees C.

A double wall shell for tubular element 22 is provided and includes an inner tube 70 and outer tube 72 both shown in dashed lines. The assembly of the inner and outer tube is appropriately achieved and a detailed description is omitted to enable a clearer understanding of the present invention. The outer tube 72 is received within circumferential surface 42, preferably with a slight interference fit and the outer tube 72 welded to the structural component 20 with the flange 62 of the sheet metal insert 56 sandwiched between the end of the tube 22 and the shoulder 44. The opposite end of tube element 22 terminates in a flange (not shown), sized to receive the circumferential Marman clamp 28. This flange mates with another flange 76 corresponding with the tube 24. As is particularly illustrated in FIG. 1, the flange of 74 and 76 provide a parting line between the diesel oxidization catalyst 32 and the diesel particulate filter 34. 34. This provides convenient access to the diesel particulate filter for inspection or routine maintenance.

Figure 3:
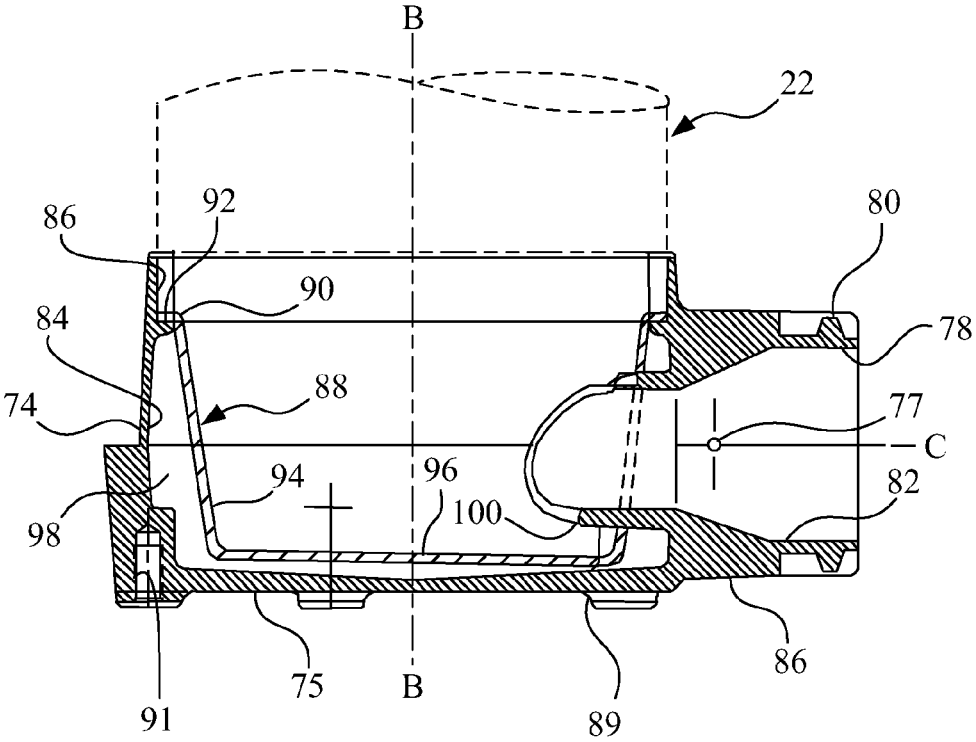
FIG. 3 is an enlarged cross-section view of an alternative arrangement for the component shown in FIG. 2.

The inlet section and structural components shown in FIG. 3 have an inlet axis C that is at 90° to the axis B. The structural component 74 has an integral inlet section 76. As illustrated the, structural component 74 and inlet section 76 are formed from a single casting. However, they may be formed from separate portions as is appropriate for casting techniques. Inlet section 76 has an inlet opening 78 and a flange 80 to accommodate the Marman clamp 15 shown in FIG. 1. A plurality of mounting basses 89 having internal threads 91 are provided on the bottom surface 75 of structural component 74. As in the case for the mounting bosses shown in FIG. 2, they may be in the same plane or otherwise as needed for a given application. A sensor mounting location 77 is provided in the inlet section 76 for a sensor (not shown) that is used in an exhaust aftertreatment control system.

An internal passage 82 leads from inlet opening 78 to an annular passage 84 having an axis substantially parallel to axis B. A circumferential surface 86 provides a mounting for the tubular element 22 in the same manner as described for the structure in FIG. 2. In order to insulate the structural component 74 from the hot exhaust gases, a sheet metal insert 88 is provided. Sheet metal insert 88 has an integral flange 90 that is supported on a flange 92 at the base of the circumferential surface 86 so that it is sandwiched between the shoulder 92 and the end of the tubular element 22. Sheet metal insert 88 has an integral sidewall 94 and bottom wall 96 to form an air gap 98 between the passage 84 and the sheet metal insert 88 to insulate the structural component 74 from the hat exhaust gases. In the embodiment shown in FIG. 3., the flow is directed through the inlet section 76, through a hole 100 and into the interior of sheet metal element 88.

The structural component and inlet sections shown in FIGS. 2 and 3 show orientations of 90 degrees and 180 degrees between the inlet axes and outlet axes. It should be apparent to those skilled in the art that axis A, C and B can be oriented in a wide range of relationships from 180° to 90° and can also be oriented so that the inlet axis A goes in the same general direction as the outlet axis B.

Referring now to FIG. 1, the result of using the structural components to support the tubular element 22 is that when the device 10 is oriented in a vertical position as shown in FIG. 1, the base 20 carries substantially all of the weight of the exhaust aftertreatment device 10 and passes the stresses through the bosses 46 to the frame 12 of the vehicle. This greatly simplifies the mounting of the device 10 because it provides a structural mounting at one end and a substantially nonstructural arrangement at the outlet end to more easily accommodate the thermal expansion. By providing the inlet sections 18, 76 and structural components 20, 74 as a casting, a wide variety of orientations between the inlet and the main portion of the device 10 may be easily provided. Assembly with the tubular element is simplified and straightforward and enables a manufacturer of the diesel oxidization catalyst and diesel particulate filter to easily integrate their structure with the integral structural component 20 and inlet 18. Furthermore, the flanged interconnections on the tubular elements enable easy swiveling to provide further flexibility.

If it is desired to mount the exhaust aftertreatment device 10 in an orientation other than vertical, the structural component 20 is mounted to the vehicle frame through the bosses 46 but an additional mounting such as a band 78 (shown in dashed lines as in FIG. 1) may be employed to handle the up and down movement of the exhaust aftertreatment device 10. Even in this arrangement, the structural component 20 provides a base from which thermal expansion can be accommodated, for example, by the ability to have a slip joint with the band 78.

Having described the preferred embodiment, it will become apparent that various modifications can be made without departing from the scope of the invention as defined in the accompanying claims.

The invention claimed is:

1. An exhaust aftertreatment device comprising:

a structural component receiving an internal combustion engine combustion gasses through an inlet integral with the said structural component, having a mounting surface formed about a given axis on a closed face of said structural component, said structural component having internal flow passages directing flow of said combustion gasses from said inlet toward a direction substantially parallel with said given axis and exiting said structural component at a circumferential surface;

a tubular shell structurally connected to said circumferential surface; and, at least one exhaust aftertreatment device positioned in and carried by said tubular shell, wherein the exhaust aftertreatment device is substantially supported by said structural component, wherein said structural component is a casting, and wherein said casting has multiple mounting bosses for providing a structural interconnection between the exhaust aftertreatment device and the frame of a vehicle with which the exhaust aftertreatment device is utilized.

2. The exhaust aftertreatment device of claim 1 wherein said inlet in said structural component is oriented in the direction approximately at a right angle to said given axis.

3. The exhaust aftertreatment device as claimed in claim 1 wherein said inlet is oriented to be directed at approximately 180° to said given axis.

4. The exhaust aftertreatment device as claimed in claim 1 further comprising a sheet metal insert configured to and spaced from said internal flow passage so as to insulate the structural component from hot exhaust gasses.

5. The exhaust aftertreatment devices claimed in claim 1 further comprising an integral circumferential flange adjacent the inlet for connecting with exhaust system components.

6. The exhaust aftertreatment device as claimed in claim 1 wherein said mounting bosses are substantially on one plane of said structural component.

7. The exhaust aftertreatment device as claimed in claim 1 further comprising a sensor mounting positioned on the exterior of said inlet section and having an internal passage to connect with said flow passage for accommodating a sensor.

8. The exhaust aftertreatment device as claimed in claim 1 wherein said exhaust aftertreatment device has two exhaust aftertreatment components.

9. The exhaust aftertreatment device as claimed in claim 8 wherein said tubular shell is formed in separate adjacent tubular sections, each accommodating one of said exhaust aftertreatment devices.

10. The exhaust aftertreatment device as claimed in claim 9 wherein said tubular sections each have a flange adjacent the junction therebetween, said flange being configured to accept a Marman clamp.

11. The exhaust aftertreatment device as claimed in claim 10 further comprising a Marman clamp positioned around the flanges on said tubular sections for releasably holding them in place.

12. The exhaust aftertreatment device as claimed in claim 8 wherein one of said exhaust aftertreatment devices is a diesel oxidization catalyst (DOC) and the other downstream of said DOC is a diesel particulate filter (DPF).

13. A vehicle comprising:

a frame;

an exhaust aftertreatment device comprising a structural component receiving an internal combustion engine combustion gasses through an inlet integral with the said structural component, having a mounting surface formed about a given axis on a closed face of said structural component, said structural component having internal flow passages directing flow of said combustion gasses from said inlet toward a direction substantially parallel with said given axis and exiting said structural component at a circumferential surface;

a tubular shell structurally connected to said circumferential surface; and, at least one exhaust aftertreatment device positioned in and carried by said tubular shell; and, said structural component being adapted to be mounted to said frame whereby the exhaust aftertreatment device is substantially supported by said structural component, wherein said structural component is a casting, and wherein said casting has multiple mounting bosses for providing a structural interconnection between the exhaust aftertreatment device and said frame of the vehicle with which the exhaust aftertreatment device is utilized.

14. The vehicle as claimed in claim 13 wherein the given axis of said exhaust aftertreatment device is oriented vertically and said structural component is on the bottom of the exhaust aftertreatment device so that the structural component provides substantially the major structural support for said tubular shell.

15. The vehicle as claimed in claim 13 wherein the given axis of said exhaust aftertreatment device is oriented other than vertically and further comprises an additional mounting for said tubular shell spaced from said structural component.

* * * * *